US005679050A

United States Patent [19]

LLorens

[11] Patent Number: 5,679,050

[45] Date of Patent: Oct. 21, 1997

[54] DEVICE FOR CLOSING ONE OR BOTH EYES OF A DOLL

[75] Inventor: Jaime Ferri LLorens, Onil, Spain

[73] Assignee: Onilco Innovacion S.A., Onil, Spain

[21] Appl. No.: 590,202

[22] Filed: Jan. 23, 1996

[30] Foreign Application Priority Data

Jul. 7, 1995 [ES] Spain ..... U950-1883

[51] Int. Cl.[6] ..... A63H 3/20

[52] U.S. Cl. ..... 446/341; 446/342

[58] Field of Search ..... 446/330, 339, 446/340, 341, 342, 389, 392, 393

[56] References Cited

U.S. PATENT DOCUMENTS

| | | | |
|---|---|---|---|
| 1,978,337 | 10/1934 | Bowers | 446/340 |
| 3,125,826 | 3/1964 | Ostrander | 446/342 X |
| 4,560,363 | 12/1985 | Garza et al. | 446/342 |
| 5,378,188 | 1/1995 | Clark | 446/330 |

FOREIGN PATENT DOCUMENTS

| | | | |
|---|---|---|---|
| 679663 | 2/1964 | Canada | 446/340 |
| 699255 | 12/1965 | Italy | 446/340 |
| 2068243 | 8/1981 | United Kingdom | 446/341 |

*Primary Examiner*—D. Neal Muir

*Attorney, Agent, or Firm*—Knobbe, Martens, Olson & Bear, LLP

[57] ABSTRACT

A device for bringing about the closure of one or both eyes of a doll composed of two rigid arms, one fixed and the other swinging. The arms pass through a mounting neck flange joining the head and body of the doll. The two arms are separated by a spring placed between them within the cavity of the body of the doll. A portion of the fixed arm within the head of the doll incorporates an axis for rotation of first ends of a pair of bent levers. The bent levers are equipped with slots through which a single pin is adapted to translate. The pins join to the end of an actuating lever affixed to the swinging arm. When manual pressure is applied to the body of the doll, the swinging arm is displaced toward the fixed arm causing the two bent levers to swing and their two free ends to move toward each other. The free ends are rotationally attached to portions above and below at least one eye, causing the eye to close. The bent levers may be attached to only one eye simulating a winking motion, or may be attached to both eyes simulating a sleeping state of the doll.

3 Claims, 1 Drawing Sheet

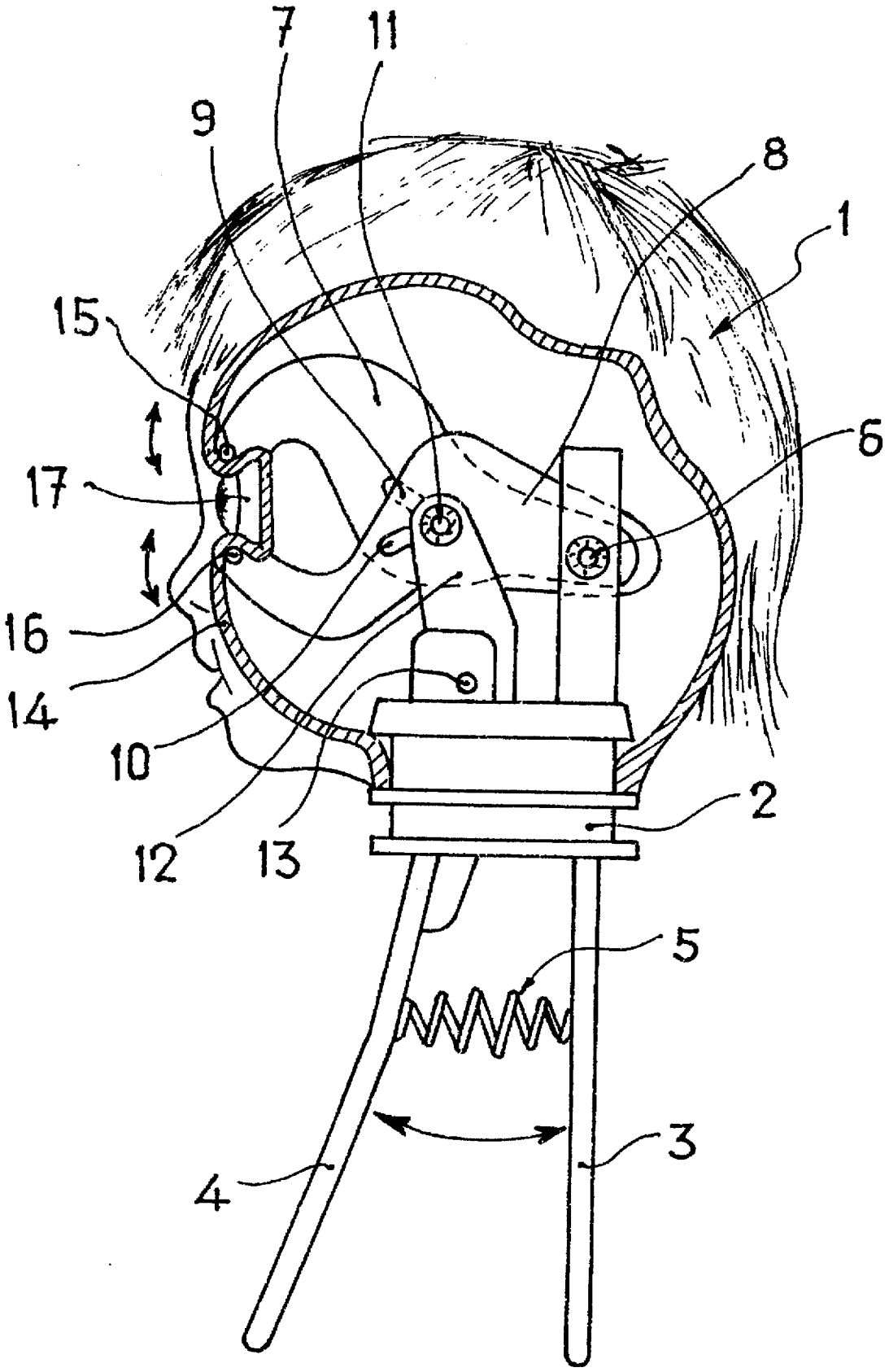
7
11
9
8
1
15
6
17
16
14
10
12
13
2
5
3
4

DEVICE FOR CLOSING ONE OR BOTH EYES OF A DOLL

FIELD OF THE INVENTION

The invention refers to a mechanical device for bringing about the closure of one of the two eyes of a doll, this device being activated by manual pressure on a part of the body of the doll, such as the chest, giving rise to the swinging of certain levers, the free ends of which are joined to the upper and lower parts of the doll's eyes, giving rise to the opening or closing of the eyes, depending on the movement of the said levers.

SUMMARY OF THE INVENTION

More specifically, the device envisaged is composed of two rigid arms which pass through the corresponding mounting neck flange of the head of the doll, these two arms being mainly located within the cavity of the body, under the head itself, while the rest, that is, a small part or the upper length of the said arms remains within the inside of the head.

One of the arms is fixed, while the other is able to swing in a direction towards the one in front, although it is kept separate from this by a spring that is interposed between them.

At the end of the fixed arm, and corresponding to that part of the same which is located within the head of the doll, two other bent levers are articulated, which may be considered to be like the arms of pincers, these being equipped with slots at approximately their mid point, one of which has a downwards inclination and the other of which has an upwards inclination, such that a common axis passes through both slots, this constituting the turning axis for a lever joined to the moving arm.

The two bent levers are equipped at their free ends with a crosswise element or pin, which is joined in one case to the place which may be considered to be the lower eyelid of the eyes, while in the other case it is joined to the upper lid, such that when these two levers swing, following activation of the swinging arm, the free end of the lower lever moves upwards and the free end of the upper lever moves downwards, thereby closing the eyes, in the case that the element or pin at the free end of the said levers is of a length which corresponds to that of the eyes, while if this length is only equivalent to that of one eye, then this will be closed while the other remains permanently open.

BRIEF DESCRIPTION OF THE DRAWINGS

Complementary to the description given below, and with the aim of helping towards better understanding of the features of the invention, a detailed description based on a set of plans enclosed with this specification will be given as an integral part of the same, and in which sheet and single drawing shown in the said set of plans a side elevation cross-section view is shown of the head of a doll with the device of the invention.

In the said FIGURE, the references correspond to:

1.—The head of the doll.

2.—The head mounting neck flange (1).

3.—Fixed arm.

4.—Swinging or moveable arm.

5.—A spring located between the arms (3) and (4).

6.—Axis of the fixed lever (3).

7.—Upper swinging lever.

8.—Lower swinging lever.

9.—Ascending slot on the lever (7).

10.—Descending slot on the lever (8).

11.—The pin within the slots (9 and 10).

12.—Actuating lever.

13.—Articulation axis of the lever (12) and arm (4).

14.—The wall of the head (1).

15.—Element or pin at the end of the lever (7).

16.—Element or pin at the end of the lever (8).

17.—Eye of the doll.

DESCRIPTION OF THE PREFERRED EMBODIMENTS

According to and as may be seen in the said drawings, the device of the invention is applicable to dolls and is mounted specifically in the head (1), this being coupled to the neck flange (2) through which it is joined to the body of the doll.

On the basis of the said features the device in the first instance includes a pair of rigid arms (3) and (4), which pass through the neck flange (2), one of them being joined to this neck flange (2) and which is to be considered to be a fixed arm (3), while the other arm (4) is mounted in such a manner that it may swing towards the other arm (3) and return to its initial position by means of a spring (5) that is located between the two and which tends to keep arm (4) separated from the other fixed arm (3).

The greater part of the length of the said arms (3) and (4) remains below the neck flange (2), and is therefore located within the cavity of the body of the doll, specifically at the height of the chest. The remaining parts of the said arms (3) and (4), after passing through the neck flange (2) are located within the cavity of the head (1).

Over the upper end of the fixed arm (3), and specifically that part which is located within the head, an axis (6) is mounted which constitutes the means by which a pair of bent levers (7) and (8) swing or turn, the first of which levers is above the other and is equipped with an ascending slot (9), while the other is below the first and is equipped with a descending slot (10), such that a pin (11) passes simultaneously through both slots, this pin corresponding to a lever (12) that is articulated at the axis (13) together with the upper part of the mobile or swinging arm (4).

The two bent levers (7) and (8) are finished at their free and front ends by an element or pin (15) and (16), respectively, the first of which is joined to that which is considered to be the upper lid of the eye or eyes (17), while the second is joined to that which is considered to be the lower lid of the said eye or eyes (17), these lids in turn forming part of the wall (14) of the head (1).

With the structure and arrangement of the device as described, closure of the eye or eyes (17) is brought about in the following way:

When manual pressure is applied on the area of the body of the doll where the arm (4) is located internally, this swings and approaches the arm (3) against the spring (5). This said movement of the arm (4) brings about the swinging of levers (7) and (8), in such a way that the pin (11) slides within their slots (9) and (10), and due to the orientation of these slots the free end of the upper lever (7) moves downwards, while the free end of the lower lever moves upwards, giving rise to the coming together of these free ends and therefore also of those elements or pins (15 and 16) within the same, bringing about the effect of the closing of the eye (17) and simulating the gesture of winking if such pins extend over only one eye, while if they extend over both eyes, then both close.

When the arm (4) ceases to be subjected to manual pressure, the force of the spring (5) brings about the recovery of its original position, while levers (7) and (8) swing in the opposite direction, and thereby opening eye or the eyes.

What is claimed is:

1. A device for bringing about the opening or closure of one or both eyes of a doll, the doll having a head and a body and a neck flange joining the head and body, comprising:

a pair of rigid arms, one fixed and the other swinging, which pass through the neck flange joining the head and body of the doll, the arms being separated within the body of the doll by a spring located between them, an axis for rotation provided in the portion of the fixed arm located within the doll's head, a pair of bent levers each mounted at a first end to rotate about the axis and rotationally attached at a free end opposite the first end to the upper and lower part, respectively, of a wall around at least one eye, both bent levers equipped with slots, a single pin which passes through both slots of the bent levers, an actuating lever on which the pin is located, being articulated to the swinging arm, in such a way that on manual pressure being applied to the body of the doll the swinging arm is displaced, causing the two bent levers to swing and bringing their free ends closer to each other, and giving rise to the closure of the eye.

2. A device for producing the closure of the eye or eyes of a doll, according to claim 1, wherein the free end of each swinging lever is rotationally attached to the upper and lower part, respectively, of a wall around both eyes, to produce the simultaneous closure of both eyes.

3. A device for producing the closure of the eye or eyes of a doll, according to claim 1, wherein the slot in the upper swinging lever is inclined upwards, while the slot in the lower swinging lever is inclined downwards.

* * * * *